US005299635A

United States Patent [19]

Abraham

[11] Patent Number: 5,299,635

[45] Date of Patent: Apr. 5, 1994

[54] PARALLEL FLOW CONDENSER BAFFLE

[75] Inventor: Anthony W. Abraham, Arlington, Tex.

[73] Assignee: Wynn's Climate Systems, Inc., Ft. Worth, Tex.

[21] Appl. No.: 27,200

[22] Filed: Mar. 5, 1993

[51] Int. Cl.[5] ..... F28F 9/22

[52] U.S. Cl. ..... 165/173; 165/150; 165/174

[58] Field of Search ..... 165/150, 153, 173, 174, 165/175, 176

[56] References Cited

U.S. PATENT DOCUMENTS

| | | | |
|---|---|---|---|
| 1,991,631 | 2/1935 | Sangster | 165/174 |
| 3,866,675 | 2/1975 | Bardon et al. | 165/173 |
| 4,382,468 | 5/1983 | Hastwell | 165/173 |
| 4,825,941 | 5/1989 | Hoshino et al. | 165/110 |
| 4,960,169 | 10/1990 | Granetzke | 165/173 |
| 5,141,048 | 8/1992 | Sausner | 165/150 |

FOREIGN PATENT DOCUMENTS

| | | | |
|---|---|---|---|
| 94074 | 3/1923 | Austria | 165/150 |
| 142105 | 2/1902 | Fed. Rep. of Germany | 165/150 |
| 184894 | 11/1982 | Japan | 165/174 |
| 302592 | 12/1990 | Japan | 165/174 |
| 99193 | 4/1991 | Japan | 165/176 |

*Primary Examiner*—John Rivell
*Assistant Examiner*—L. R. Leo
*Attorney, Agent, or Firm*—James E. Bradley

[57] ABSTRACT

The air conditioner condenser includes a set of hollow parallel tubes disposed between a pair of header pipes. The header tubes provide fluid flow between the header pipes and are substantially flat, having parallel upper and lower side walls. The walls have inner and outer surface and are separated by longitudinally extending webs defining separate flow passages. A partition or baffle is formed by removing one of the upper or lower walls from a tube having a length greater than that of the other tubes. The header pipe has a series of slots, each having similar dimensions. The tubes are inserted into the slots and sealed, with the extended portion of the extended tube forming the partition or baffle.

6 Claims, 2 Drawing Sheets

PARALLEL FLOW CONDENSER BAFFLE

BACKGROUND OF THE INVENTION

1. Field of the Invention

This invention relates to an air conditioner condenser, in particular, to baffles or partitions that are located in header pipes of the condenser, the baffles being formed from an extended portion of tubes disposed between the header pipes.

2. Description of the Prior Art

Parallel flow heat exchangers or condensers used in air conditioners usually consist of a set of header pipes which are joined by a set of parallel tubes. The tubes are joined to the header pipes so that fluid may flow from one header pipe to another. It is important that the tubes have a large surface area so that heat may be transferred through the tubes. As the fluid flows through the header pipes and tubes, the fluid is cooled. In order to provide more surface area over which cooling can take place, several tubes are provided which allow the fluid to pass from one header pipe to another.

Typically, the fluid flows into an inlet of one of the header pipes until it reaches a baffle. The baffle is inserted inside the header pipe to divert the fluid flow through the header pipe into a group of parallel tubes. The fluid then flows out of the tubes into another header pipe. This header pipe may also have a baffle that diverts the fluid flow into a second group of parallel tubes. By providing several sets of parallel tubes and baffles in the condenser, the fluid can be passed over a very large surface area of the tubes within a limited amount of space.

The prior art shows a variety of methods for positioning the partitions in the header pipes. One method is to insert the partitions through slots in the header pipe. Another proposed method shows a collar on each partition, the collar sliding over one of the parallel flow tubes.

SUMMARY OF THE INVENTION

This invention consists of an air conditioner condenser having a set of hollow parallel tubes. Each of the tubes has substantially flat, parallel upper and lower walls. The tubes have longitudinally extending webs which separate the upper and lower walls and define separate flow passages within the tubes. A pair of header pipes have slots through which the ends of the tubes are inserted for providing fluid communication between the header pipes. An extended tube, having a length greater than that of the other tubes, is used to form a baffle or partition. The baffle is created from an extended portion of the extended tube by removing a portion of one of the upper or lower walls of the tube and leaving the other upper or lower wall to fill the interior of the header pipe. The baffle or extended portion is then used to divert fluid flow through the header pipe and into the tubes.

DETAILED DESCRIPTION OF THE INVENTION

Figure 1:
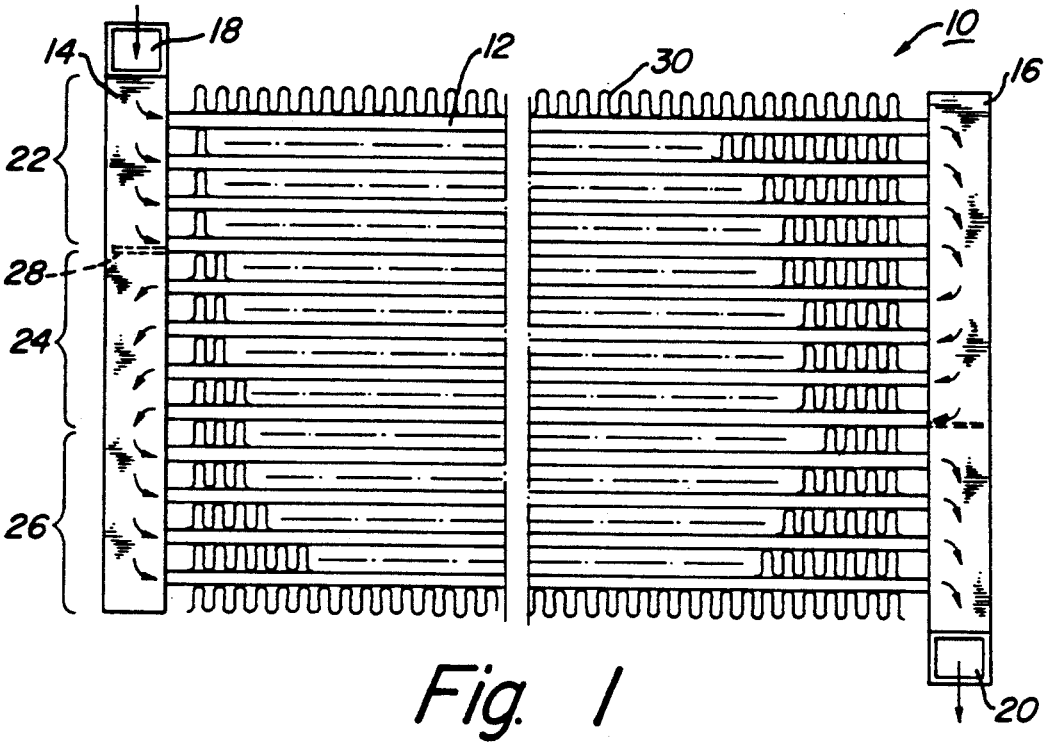
FIG. 1 is a front view of an air conditioner condenser embodying the present invention.

FIG. 1 shows a heat exchanger or air conditioner condenser 10 having a set of parallel tubes 12. The tubes 12 are joined at each end to header pipes 14 and 16. The header pipes 14, 16 are provided with an inlet 18 for fluid flowing into the condenser 10, and an outlet 20 for fluid flowing out of the condenser 10. The tubes 12 are divided into groups 22, 24 and 26. Each group 22, 24 and 26 is divided by partitions or baffles 28 located in the header pipes 14, 16.

Figure 2:
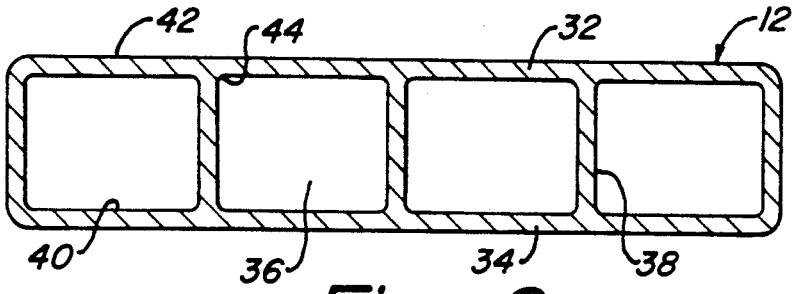
FIG. 2 is a cross sectional view of one of the tubes of FIG. 1.

The condenser tubes 12 are formed from aluminum by extrusion or other conventional methods. As seen in FIG. 2, the tubes are hollow and have a substantially flat cross sectional area. Corrugated fins 30 are attached to each of the tubes 12 for conducting heat away from the tubes 12. Each tube 12 has substantially flat, corresponding parallel upper and lower walls 32, 34 and is provided with multiple pathways or passages 36. The passages 36 are formed by longitudinally extending webs 38 that separate the upper and lower walls 32, 34. The webs 38 provide structural support between the walls 32, 34.

Each wall 32, 34 has an inner surface 40 and an outer surface 42. The web 38 intersects the inner surface 40 of each wall 32, 34 forming a corner 44 of each passage 36. Each corner 44 is rounded, forming a fillet.

Figure 3:
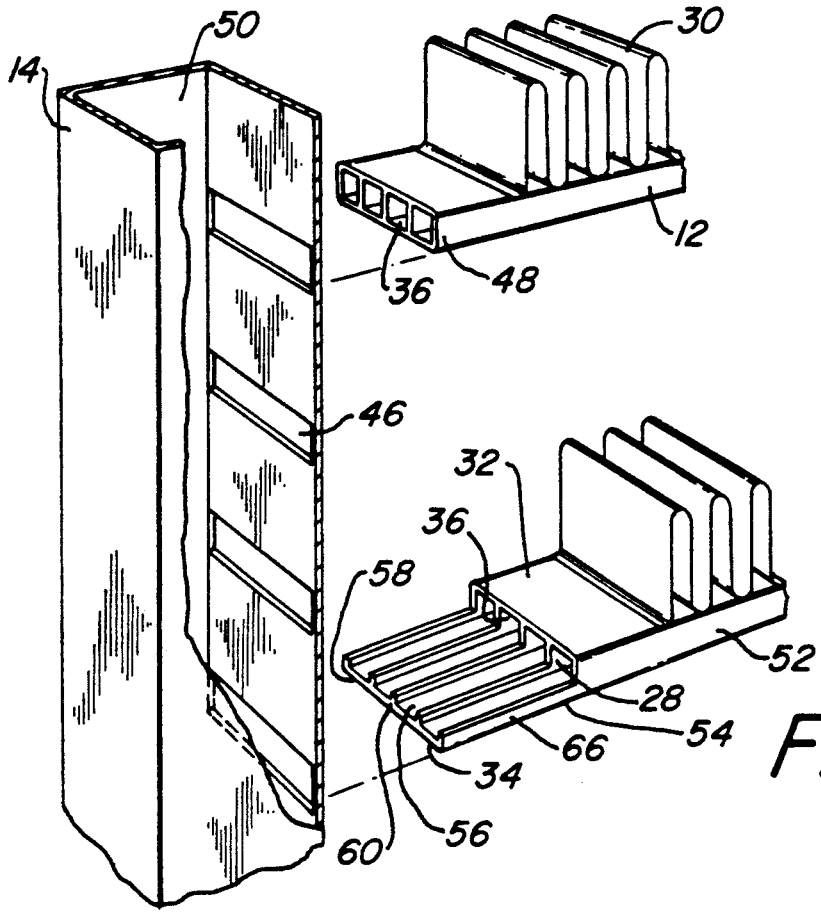
FIG. 3 is a perspective view showing the header pipe in relation to the tubes and the partition formed by an extension of one of the tubes.
Figure 4:
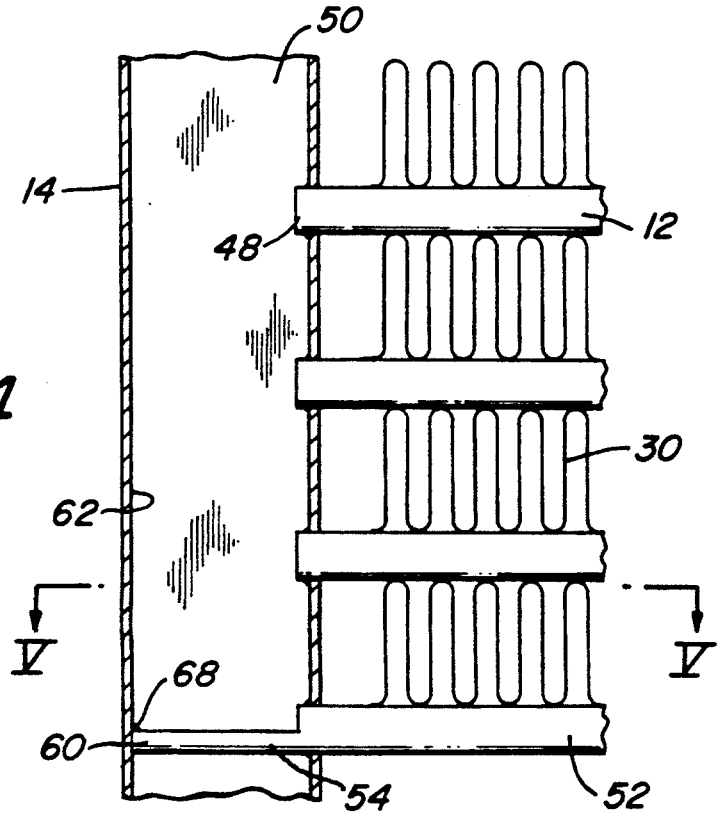
FIG. 4 is a side cross sectional view of the header pipe, showing the relationship between the tubes when inserted into the header pipe.

As shown in FIG. 3, the header pipes 14, 16 each have a series of slots 46 into which the ends 48 of each tube 12 may be inserted. FIG. 4 shows the ends 48 of the tubes 12 protruding into the interior 50 of header pipe 14. In the embodiment shown, header pipes 14, 16 are rectangular in cross section and are integrally formed. The width of each header pipe 14, 16 is substantially the same as the width of each tube 12.

By providing a tube 52 (FIG. 3) with a length greater than that of the other tubes 12, the partition 28 is formed from an extended portion 54 that is integrally formed with the tube 52. The tube 52 is constructed in the same manner as the tubes 12, however, the extended portion 54 is formed by cutting a portion of one of the walls 32, 34 from an end of the extended tube 52. FIG. 3 shows the tube 52 With a portion of the upper wall 32 removed and the lower wall 34 remaining to form the extended portion 54. The extended portion 54 has an inner surface 56 and an outer surface 58. Passages 36 of the extended tube 52 remain open after the extended portion 54 is formed so that fluid may flow through the tube 52. Portions of the web 28 remaining on the inner surface 56 of the extended portion 54 of tube 52 provide structural support to the extended portion 54.

In construction of the condenser 10, the ends 48 of the tubes 12 are inserted into slots 46 so that the edges of each slot 46 sealingly engage each tube 12. This may be accomplished by any conventional means, such as soldering or brazing. As shown in FIG. 3, the slots 46 all have the same or similar dimensions. There is no need to modify the slots 46 of the header pipes 14, 16 in order to accommodate the extended portion 54 of the extended tube 52. Because the width of the extended portion 54 is substantially the same as the width of the tubes 12, the extended tube 52 is merely inserted into one of the slots 46, in the same manner as described for the tubes 12 above, so that the slot sealingly engages the tube 52. When the extended tube 52 is inserted into the slot 46, the end 60 of the extended portion 54, shown in FIG. 4, will abut a rear interior wall 62 (FIG. 4) of the header pipe 14.

Figure 5:
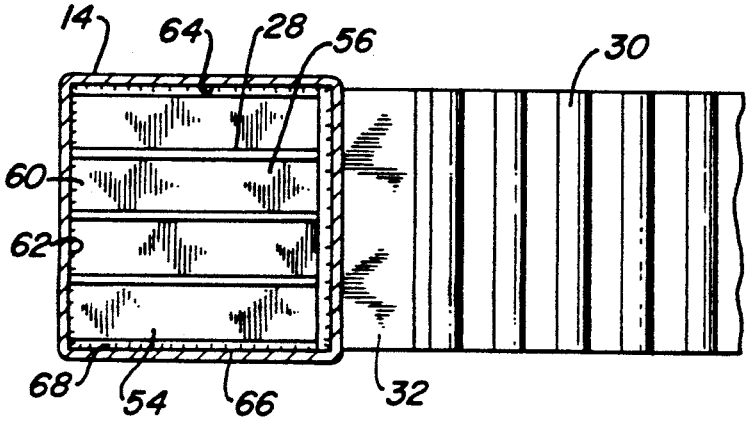
FIG. 5 is a top cross sectional view of the header pipe and extended tube of FIG. 4, taken along the lines V—V.

As shown in FIG. 5, the interior walls 64 of the header pipe 14 closely receive the edges 66 of the extended portion 54, with the extended portion 54 filling the interior 50 of the header pipe 14. It should be noted, however, that the extended portion 54 could be cut to fit the interior of a variety of header pipes having different cross sectional configurations. The edges 66 of the extended portion 54 are coated with a brazing compound. The edges 66 of the extended portion 54 are then soldered, brazed or otherwise sealed to the header pipes 14, 16, forming a seal 68.

As shown by the arrows in FIG. 1, the operation of the condenser 10 occurs as follows. Fluid enters the inlet 18 of header pipe 14. The fluid flows through the first header pipe 14 until it reaches one of the partitions 28 formed from an extended portion 54 of one of the extended tubes 52. This forces the fluid to flow through the first group of tubes 22 attached to the header pipe 14 above the partition 28. Fluid flowing through the header pipe 14, which contacts the inner surface 56 of the extended portion 54 forming the partition 28, will also flow into tube 52 of group 22. The fluid then flows out of the first group of tubes 22 into the second header pipe 16. The fluid is diverted by partitions 28 in header pipe 16, forcing the fluid to flow in the opposite direction through the second group of tubes 24. The fluid is then forced through the third group of tubes 26 and out of the condenser 10 through outlet 20.

The construction of the condenser 10 allows fluid to be passed over a very large surface area within a limited amount of space. As the fluid flows through the condenser 10, the fluid is cooled by air passing over the tubes 12 and fins 30.

The invention is an improvement over prior art methods of forming baffles or partitions in header pipes of air conditioner condensers. The header pipe used in the invention is simply provided with a series of slots into which the condenser tubes are inserted. By lengthening one or more of the tubes to form an extended portion, and removing a portion of a wall, a partition or baffle can be formed. The modified tube is then inserted into one of the slots in the header pipe without altering the slot or creating a new one. This allows the manufacturer to form the air conditioner condenser without predetermining where the baffle should be inserted.

Because the partition is formed from one of the tubes, there is no need to manufacture a separate baffle or partition. The tube is able to function as both a baffle and a conduit for fluid flow.

While the invention has been shown in only one of its forms, it should be apparent to those skilled in the art that it is not so limited, but is susceptible to various changes without departing from the scope of the invention.

I claim:

1. An air conditioner condenser, comprising in combination:

a set of generally parallel tubes, each of the tubes being substantially flat and having opposite ends and parallel upper and lower walls separated by longitudinally extending webs which define separate flow passages;

a pair of oppositely disposed header pipes, the ends of the tubes being connected to the header pipes for providing fluid communication between the header pipes, the header pipes each having interior walls that define a hollow interior; and at least one of the ends of the tubes in each header pipe having an extended portion in which one of the upper and lower walls has been removed while the other of the upper and lower walls remain, the extended portion sealingly engaging the interior walls of the header pipe in which the extended portion locates for diverting fluid flow through said one of the header pipes; and wherein a portion of the webs are also located on each of the extended portions of the tubes for strengthening the extended portions of the tubes.

2. The condenser of claim 1, wherein:

the extended portion is integrally formed on the tube.

3. The condenser of claim 1, wherein:

the interior of the header pipe has a substantially rectangular cross section and wherein the extended portions have substantially rectangular end portions.

4. An air conditioner condenser, comprising in combination:

a set of hollow parallel tubes, each tube having opposite ends and substantially flat, parallel upper and lower walls, the walls having an inner and an outer surface, the walls being separated by longitudinally extending webs which define separate flow passages;

a pair of header pipes oppositely disposed and having a set of slots through which the end of the tubes insert for providing fluid communication between the header pipes, the header pipes each having interior walls that define a hollow interior; and at least two of the tubes being extended tubes having lengths greater than the other of the tubes so that an extended portion of one of said extended tubes sealingly engages the interior walls of one of the header pipes and an extended portion of the other of said extended tube sealingly engages the interior walls of the other of the header pipes;

the extended portions being integrally formed with the extended tubes by removing the upper wall and leaving the lower wall in the extended portion, the extended portion defining partitions for diverting fluid flow through the header pipes; and wherein a portion of the webs are also located on each of the extended portion of the tubes for strengthening the extended portions of the tubes.

5. The condenser of claim 4, wherein:

the interior of the header pipe has a substantially rectangular cross sectional area, and wherein the extended portions have substantially rectangular end portions.

6. A method of constructing an air conditioner condenser, the method comprising the steps of:

providing a set of generally parallel tubes, each of the tubes being substantially flat, having parallel upper and lower walls separated by longitudinally extending webs which define separate flow passages;

providing a pair of oppositely disposed header pipes, each header pipe having a set of slots through which the ends of the tubes can be inserted;

providing at least one of the tubes that is an extended tube having a length that is greater than the length of the other tubes;

removing at least one of the upper and lower walls at an end of said extended tube and leaving the other of the upper and lower walls to define an extended portion and a portion of the webs on the extended portion; then inserting the ends of the tubes into the slots of the header pipes so that the tubes are sealingly engaged with the edges of the slots for providing fluid communication between the header pipes; and inserting the extended portion of the extended tube into one of the slots of the header pipes so that the remaining upper and lower wall sealingly engages the interior walls of the header pipe in which the extended portion locates for diverting fluid flow through said one of the header pipes.

* * * * *